US006949007B1

(12) United States Patent
Wang et al.

(10) Patent No.: US 6,949,007 B1
(45) Date of Patent: Sep. 27, 2005

(54) SYSTEM AND METHOD FOR MULTI-STAGE PROCESS CONTROL IN FILM REMOVAL

(75) Inventors: Kuo-Hwa Wang, Kaohsiung (TW); Chii-Ping Chen, Hsinchu Hsien (TW)

(73) Assignee: Taiwan Semiconductor Manufacturing Co., Ltd., Hsinchu (TW)

( * ) Notice: Subject to any disclaimer, the term of this patent is extended or adjusted under 35 U.S.C. 154(b) by 0 days.

(21) Appl. No.: 10/930,886

(22) Filed: Aug. 31, 2004

(51) Int. Cl.[7] ..... B24B 1/00

(52) U.S. Cl. ..... 451/5; 451/8; 451/9; 451/41; 438/633; 438/645; 438/672; 700/108; 257/509; 257/524

(58) Field of Search ..... 451/5, 8, 9, 41, 451/59, 285–290; 438/633, 645, 672, 699, 438/701, 759, 760; 700/108; 257/509, 510, 257/524, 752

(56) References Cited

U.S. PATENT DOCUMENTS 6,258,711 B1 * 7/2001 Laursen ..... 438/633
6,468,131 B1 * 10/2002 Korovin ..... 451/5
6,552,408 B2 * 4/2003 Robinson et al. ..... 257/509
6,671,570 B2 * 12/2003 Schulze ..... 700/121
6,696,367 B1 * 2/2004 Aggarwal et al. ..... 438/758

* cited by examiner

*Primary Examiner*—Lee D. Wilson
*Assistant Examiner*—Anthony Ojini
(74) *Attorney, Agent, or Firm*—Thomas, Kayden, Horstemeyer & Risley

(57) ABSTRACT

A fabricating system. A processing tool executes a film removal process on a wafer using a chemical mechanism. A metrology tool monitors surface characteristics of the wafer to obtain a measured film thickness thereof before and after a first removal process, wherein the first removal process lasts a first processing duration. The controller, coupled to the processing and metrology tools, determines whether the difference between the measured film thickness and a preset film thickness exceeds a preset value, and determines a second processing duration of a second removal process according to the measured and preset film thickness and the first processing duration.

18 Claims, 5 Drawing Sheets

SYSTEM AND METHOD FOR MULTI-STAGE PROCESS CONTROL IN FILM REMOVAL

BACKGROUND

The present invention relates to film planarity process control and particularly to multi-stage process control in chemical mechanical polishing.

A polishing system that uses chemical slurry is commonly known as a chemical mechanical polishing (CMP) system. CMP rely on provides both mechanical polishing and chemical action to remove film for global planarity. In contrast with mechanical polishing, the slurry in a CMP system provides an increased removal rate of substrate material. Additionally, by selecting particular chemicals, chemical slurry can selectively remove specific film types from a semiconductor substrate.

Currently, CMP is widely used for planarization of inter-level dielectrics and metal layers. The CMP process is achieved by sliding a wafer surface on a relatively soft polymeric porous pad flooded with chemically active slurry containing abrasive particles of sub-micron diameter. The mechanical properties of the polishing pad and its surface morphology control the quality and efficacy of the CMP process. The pad surface morphology controls the partition of the applied down pressure between the abrasive particles and direct wafer/pad contact. The pad distributes the slurry, supports the wafer polishing pressure and the shearing action of the slurry against the wafer surface while removing polishing residue. In addition, the polishing pad behaves in elastic and/or viscoelastic manner under the applied pressure, which is thought to affect the WIWNU (within wafer non-uniformity) or planarity. In practice, it is not clear what pad property should be measured to characterize the polishing results.

Because of the chemically active slurry, CMP is more effective in polishing and more difficult to control. The CMP process is frequently carried out without comprehensive information about current polishing conditions and controlled according to empirical polishing rate and time. Since such polishing control methods are inaccurate, the polishing process can result in yield loss and waste of expensive wafers. Therefore, accurate control of polishing based on reliable real-time information is an important issue for automation of such processes.

One problem encountered in CMP is the unstable removal rate thereof. Removal rate is proportional to downward pressure on a wafer, rotational speeds of the platen and wafer, slurry particle density and size, slurry composition, and the effective area of contact between the polishing pad and the wafer surface. The conditions of the polishing pad and slurry, having great impact on the CMP process, change during the process and are difficult to monitor and control.

Model-based control is a frequently used method to control CMP process, which calculates removal rate and polishing time for a wafer according to a preset model and conditions of a preceding CMP process run.

Such conventional CMP process control has several disadvantages.

First, the model-based control method performs a CMP process as defined by the preset model and calibrates the CMP process accordingly. Therefore, when the model is inaccurate, wafers processed by the erroneous CMP process may suffer undue polishing and need to be re-polished or scrapped. In addition, the model setting based on experience is unstable due to manual intervention.

Second, removal rate in a CMP process is influenced by numerous factors and cannot be kept constant throughout the polishing process. The conventional method predicts a polishing time under an assumption of constant removal rate. Because of the deviation in removal rate, the polishing process causes undue removal amount in the preset polishing time. This undue removal amount results in the need for re-polishing or scrapping of the processed wafer. FIG. 1 is a graphic representation of film thickness bias (y axis) for different polishing times (x axis). The film thickness bias is the difference between a measured film thickness and a preset film thickness target. A removal rate is a reduced amount of the bias per unit of polishing time. Theoretically, a CMP process can be controlled properly to achieve a constant removal rate, shown in FIG. 1 as a dotted line A. However, the experimental observation shows a deviant material removal rate, shown in FIG. 1 as a solid line B. When the film thickness bias exceeds a preset value b, the wafer requires either re-polishing or scrapping.

Third, re-polishing processes of wafers have a great impact on the fabricating system. Since polishing is one of the key processes in manufacture, re-polishing not only wastes resources but also results in the polishing tool becoming a bottleneck in the fabricating system.

Hence, there is a need for a process control system that addresses undue removal arising from the existing CMP technology.

SUMMARY

It is therefore an object of the invention to provide a system and method for multiple-phase process control to improve the process accuracy of film removal. To achieve this and other objects, the present invention provides a system and method dividing wafer polishing process into multiple phases and using actual removal rate of a preceding process run to determine polishing time of a current process run.

According to the invention, a fabricating system comprising a processing tool, a metrology tool, and a controller is provided. The processing tool executes a film removal process to achieve global planarity on a wafer using a chemical mechanism. The metrology tool monitors surface characteristics of the wafer to obtain a measured film thickness thereof before and after a first removal process, wherein the first removal process takes a first processing duration. The controller, coupled to the processing and metrology tools, determines whether the difference between the measured film thickness and a preset film thickness exceeds a preset value, and determines a second processing duration of a second removal process according to the measured and preset film thickness and the first processing duration.

The invention also provides a method of film removal processing in the aforementioned fabricating system. First, a preset target value of film thickness ($T_0$) is provided, and an initial film thickness ($T_i$) of a wafer is measured. Second, a first removal process run of the wafer is performed. Then a first film thickness ($T_1$) is measured after the first removal process run, wherein the first removal process run progresses for a first processing duration ($t_1$). Next, it is determined whether a difference from the first film thickness exceeds a preset thickness limit, and if so, a first removal rate is determined, wherein the first removal rate is $R_1=(T_1-T_i)/t_1$. A second processing duration is determined according to the first removal rate ($R_1$) and the first film thickness ($T_1$). Then, a second removal process run of the wafer is performed for the second processing duration.

The above-mentioned method may take the form of program code embodied in a tangible media. When the program code is loaded into and executed by a machine, the machine becomes an apparatus for practicing the invention.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION

The present invention will now be described with reference to FIGS. 2 to 5, which in general relate to a process control system within a fabricating system. While the preferred embodiment of the invention operates with CMP processes, it is understood that any single-wafer film removal process using chemical mechanism may operate with the present invention.

Figure 1:
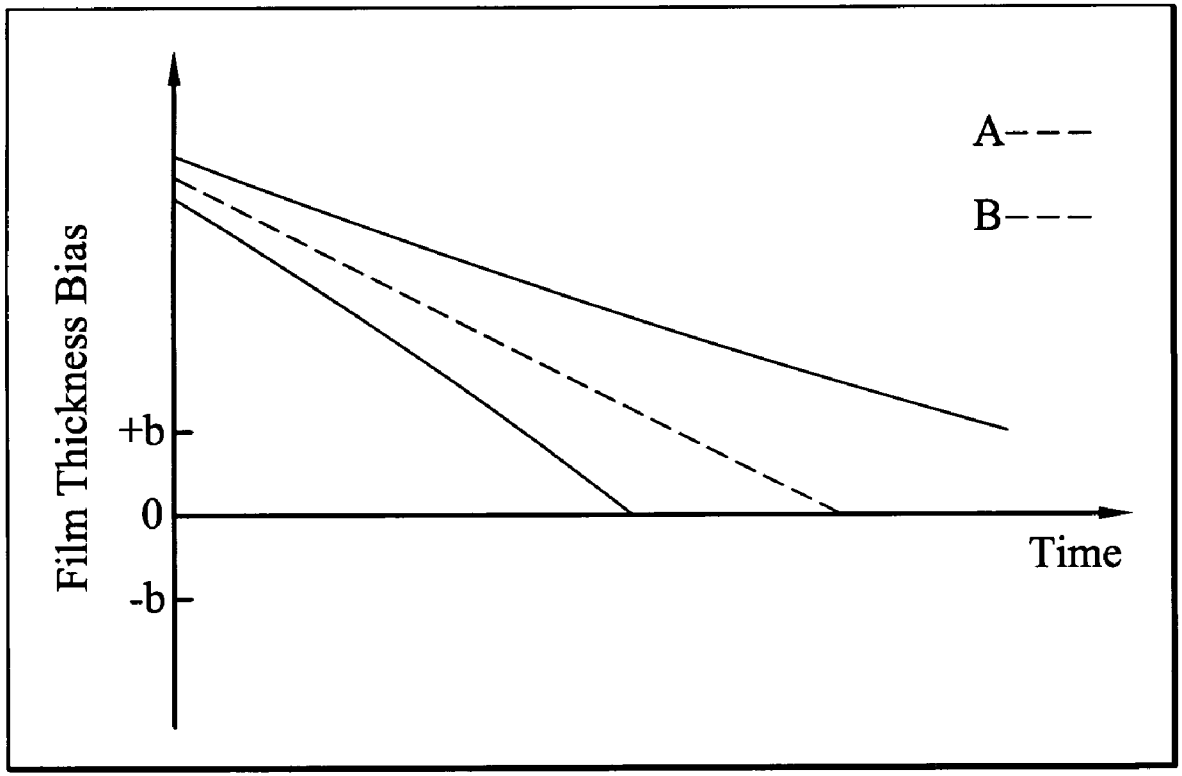
FIG. 1 (RELATED ART)
FIG. 1 is a graphic presentation of film thickness bias during different processing duration in a conventional CMP process.
Figure 2:
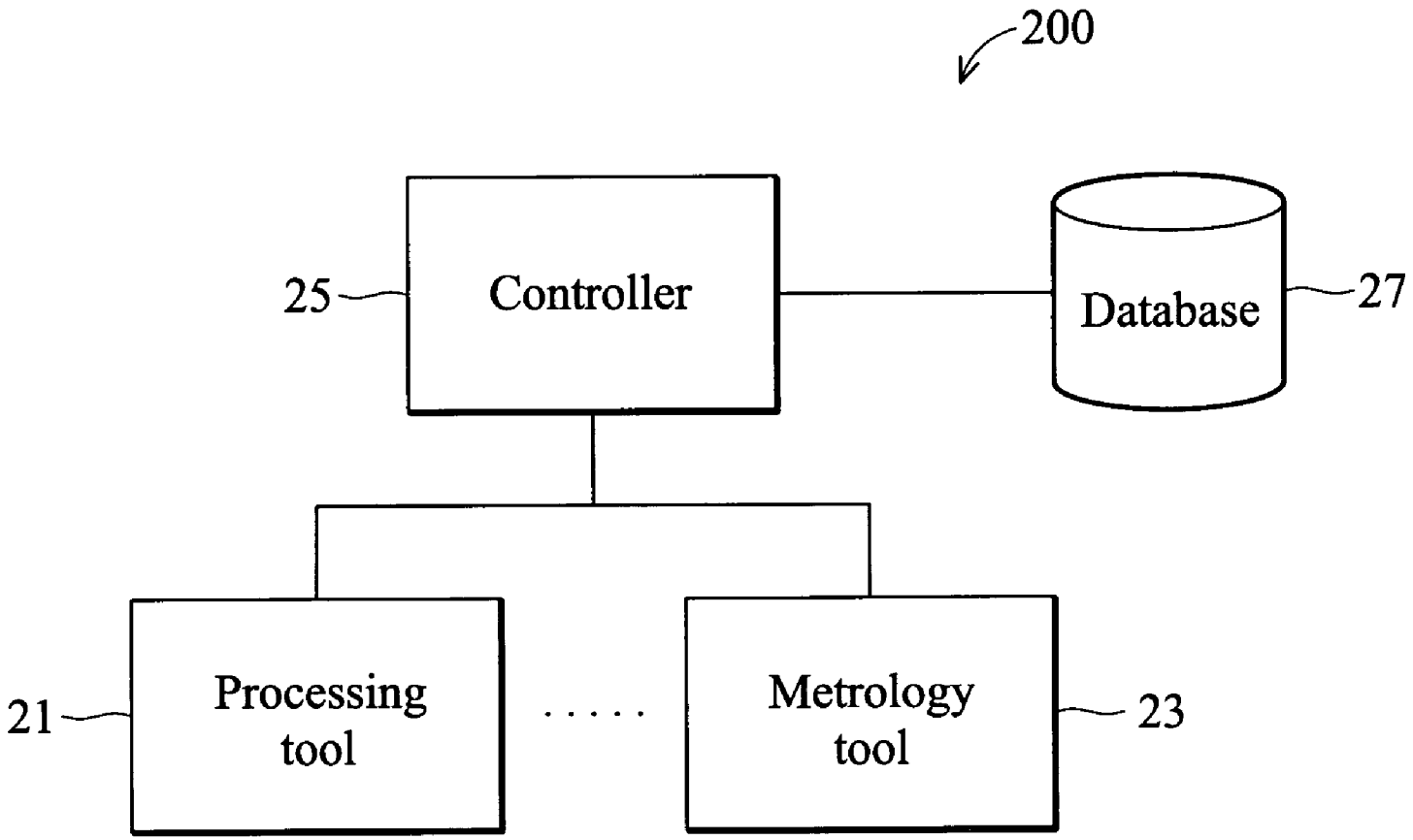
FIG. 2 is a schematic view of a fabricating system according to the present invention.

FIG. 2 is a schematic view of a fabricating system according to the present invention. Fabricating system 200 is a semiconductor fabricating system performing CMP process on semiconductor wafers.

The fabricating system 200 contains a processing tool 21, a metrology tool 23, and a controller 25. The processing tool 21 performs CMP process on a wafer using chemical mechanism. The metrology tool 23 monitors surface characteristics of the wafer processed by the processing tool 21 to measure film thickness and uniformity thereof before and after a process stage. Both processing tool 21 and metrology tool 23 are connected to controller 25. The aforementioned processing and metrology tools cooperate but are not necessarily connected directly. The controller 25, connected to the database 27, receives film thickness measures obtained by the metrology tool 23, retrieves a preset target value of film thickness and a preset thickness limit from the database 27, and determines whether the film thickness measure exceeds the preset thickness limit. When the film thickness measure exceeds the preset thickness limit, controller 25 further determines a processing duration of a subsequent process stage according to film thickness data and removal rate of a preceding process stage. The controller 25 sends a process command to direct the processing tool 21 to perform a process stage for the corresponding processing duration.

Figure 3:
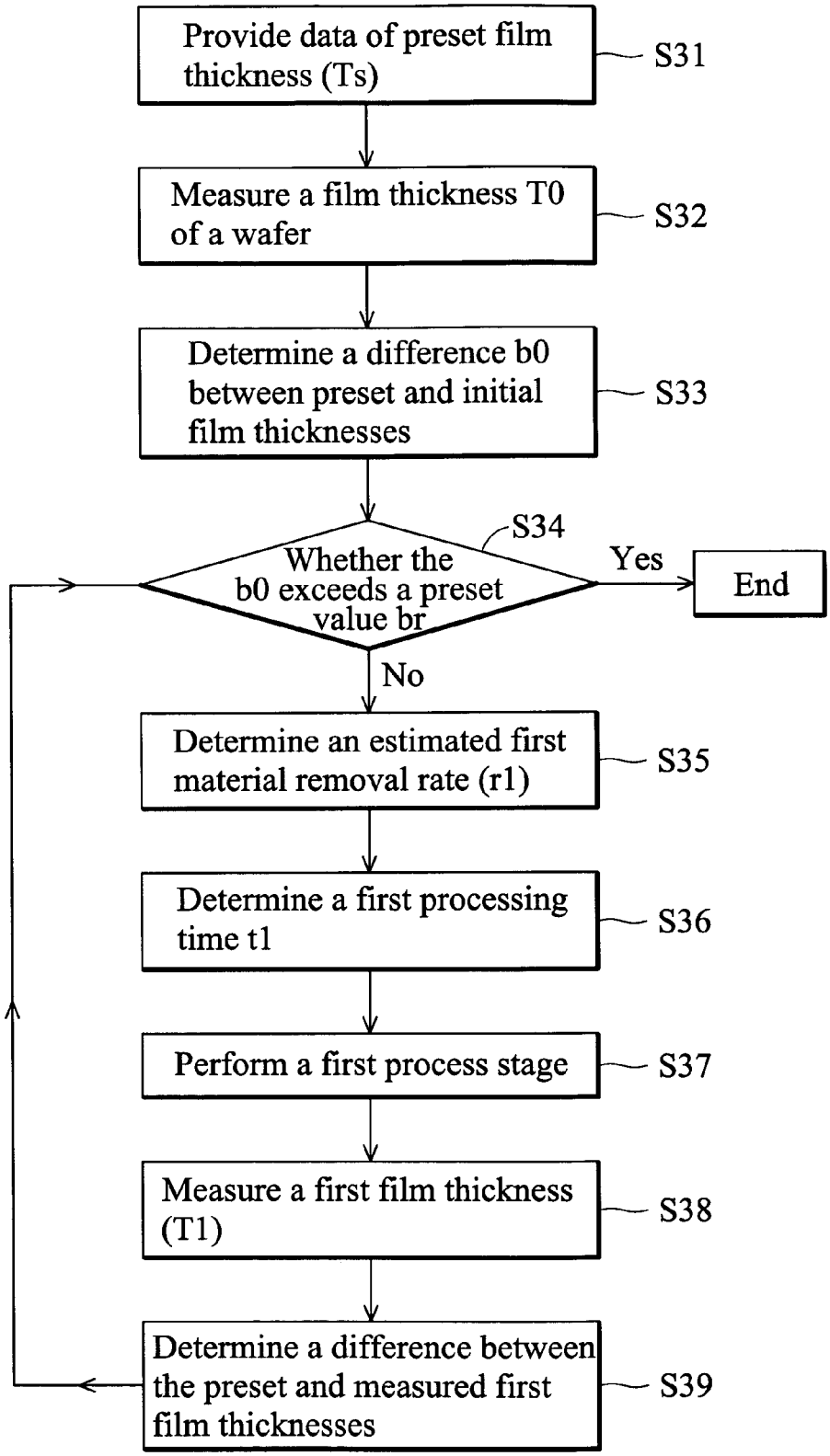
FIG. 3 is a flowchart of the CMP process operation of the system in FIG. 2.

FIG. 3 is a flowchart of a method for CMP processing in the fabricating system mentioned above. The CMP process, with a single-wafer load size, is divided into multiple stages.

First, a preset target value of film thickness ($T_0$) is provided (step S31). The preset target value, stored in the database 27 together with a corresponding film thickness limit, is a desired final film thickness on a wafer.

Second, an initial film thickness measure ($T_i$) of a wafer is obtained before the CMP process starts (step S32). Then, a difference between the preset target value ($T_0$) and initial film thicknesses ($T_i$) is determined (step S33), wherein the difference is an initial film thickness bias ($b_0$) of the wafer. The CMP process has a film thickness range ($b_r$). After the $b_0$ is determined, it is determined whether the $b_0$ exceeds br (step S34), and if so, the method proceeds to step S35, otherwise the method is completed.

When the initial film thickness bias b0 exceeds the film thickness range $b_r$, a CMP process must be repeated until a bias thereof fits into the film thickness range. In order to determine a first processing duration of a first CMP stage, an estimated first removal rate ($r_1$) is determined (step S35). Removal rate in a CMP process is controlled by mechanical properties of the polishing pad and conditions of the slurry used in the CMP process. The conditions of the polishing pad and slurry change continuously over consecutive CMP operations. Therefore, removal rates also change. The estimated first removal rate ($r_1$) is determined according to a removal rate of a preceding CMP operation. The removal rate is influenced by factors other than polishing pad and slurry used in a CMP process. Therefore, a gain value is used to modify the removal rate of the preceding CMP operation to compensate the variation in removal rate. The gain value is based on a statistical characteristic of a plurality of removal rate records of a plurality of CMP process runs, and can be determined by any known method. According to the present invention, the gain value is calculated using the following equation.

$$GAIN_{K+1} = \frac{1}{\sigma^R\sqrt{2\pi}} e^{-\frac{(R_k - R_{k-1})^2}{2\sigma^2 R}}$$

The estimated first removal rate ($r_1$) is a product of the removal rate of the preceding CMP operation and the gain value.

Figure 4:
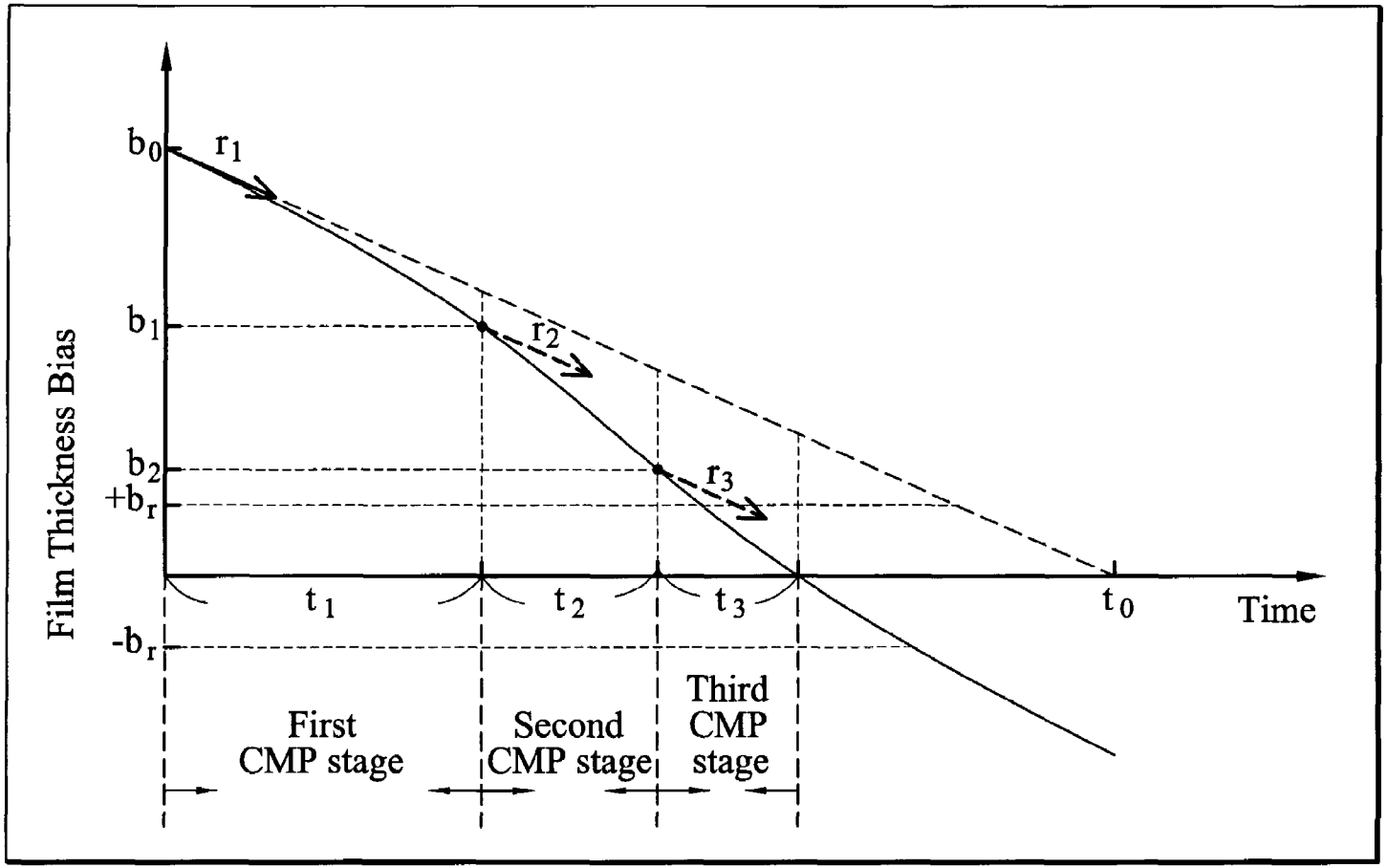
FIG. 4 is a graphic presentation of film thickness bias during different processing duration in the CMP process of the present invention.

After the estimated first removal rate ($r_1$) is determined, a first processing duration ($t_1$) is determined accordingly (step S36), wherein b0 divided by $r_1$ is $t_1$. Referring to FIG. 4, the first process stage processes the wafer for a first processing duration $t_1$, and reduces the film thickness bias from $b_0$ to $b_1$ (step S37).

When the first CMP stage is completed, a first film thickness ($T_1$) is measured (step S38). The measurement is accomplished using an embedded metrology tool, thus the wafer can be inspected in the process line without leaving the processing tool.

Then, a difference between the preset target value and first film thickness measure is determined (step S39), wherein the difference is a film thickness bias $b_1$ of the wafer. Next, the method proceeds to step S34 to determine whether a second process stage is required.

Using FIG. 4 as an example, the CMP process is divided into 3 stages, each of which has a different removal rate and processing duration. The first, second, and third CMP stages have processing durations of $t_1$, $t_2$, and $t_3$, respectively. As described above, the estimated first removal rate $r_1$ is determined according to a removal rate of the preceding CMP operation and the gain value (G). The first processing duration t1 is determined according to the following equation:

$$t_1 = b_0/(R_0 * G) = b_0/r_1$$

Similarly, an estimated second polishing rate r2 is determined according to an actual removal rate R1 of the first CMP stage and the gain value, wherein the $R1=(b_0-b_1)/t_1$, and a second processing duration $t_2$ is determined according to the following equation:

$$t_2=b_1/(R_1*G)=b_1/r_2$$

A third processing duration $t_3$ is determined according to the aforementioned method.

The CMP process takes a total processing duration of $(t_1+t_2+t_3)$ to achieve the target value of film thickness using the method of the present invention. According to the traditional single phase CMP process, the CMP process would have a processing duration to, wherein $b_0$ divided by an estimated removal rate is to, and the estimated removal rate is determined by experience. As shown in FIG. 4, if the wafer is processed for $t_0$, the wafer would be over-polished with a film thickness bias exceeding $b_r$ and scrapped.

The method of the present invention, or certain aspects or portions thereof, may take the form of program code (i.e. instructions) embodied in a tangible media, such as floppy diskettes, CD-ROMS, hard drives, or any other machine-readable storage medium, wherein, when the program code is loaded into and executed by a machine, such as a computer, the machine becomes an apparatus for practicing the invention. The methods and apparatus of the present invention may also be embodied in the form of program code transmitted over some transmission medium, such as electrical wiring or cabling, through fiber optics, or via any other form of transmission, wherein, when the program code is received and loaded into and executed by a machine, such as a computer, the machine becomes an apparatus for practicing the invention. When implemented on a general-purpose processor, the program code combines with the processor to provide a unique apparatus that operates analogously to specific logic circuits.

Figure 5:
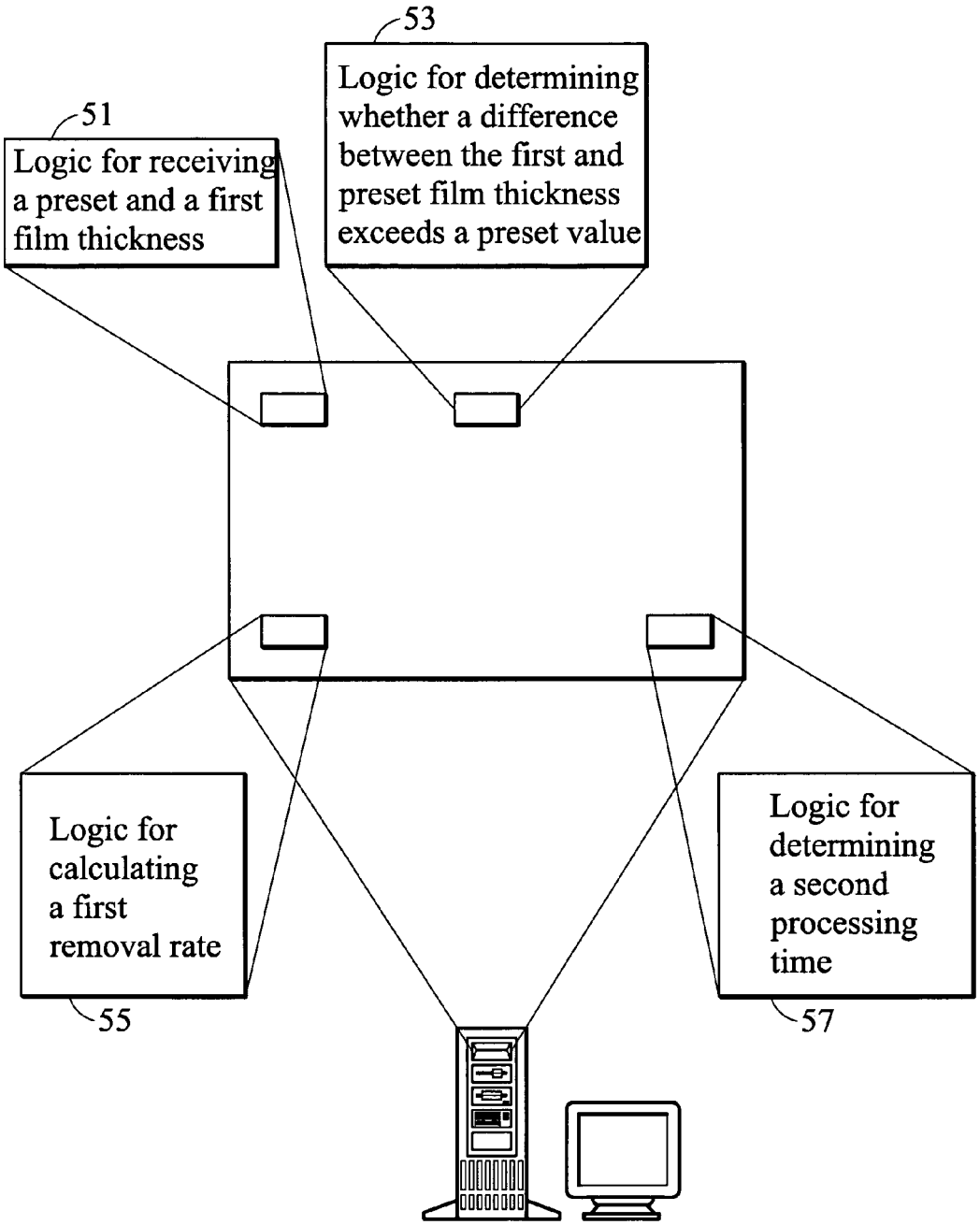
FIG. 5 is a diagram of a storage medium for storing a computer program providing the process control method.

FIG. 5 is a diagram of a storage medium storing a computer program providing the process control method according to the present invention. The computer program product comprises a computer usable storage medium having computer readable program code embodied in the medium, the computer readable program code comprising computer readable program code 51 receiving a preset target value film thickness ($T_0$) and a first film thickness measure before and after a first processing stage, computer readable program code 53 determining whether the first film thickness measure exceeds a preset film thickness limit, computer readable program code 55 calculating removal rate, and computer readable program code 57 determining a processing duration according to removal rate and film thickness measurement.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fabricating system, comprising:

a processing tool performing a multi-stage film removal process on a wafer using chemical mechanism;

a metrology tool monitoring surface characteristics of the wafer to obtain initial and first film thickness measures thereof before and after a first process stage, wherein the first process stage continues for a first processing duration; and a controller, coupled to the processing and metrology tools, determining whether the first film thickness measure exceeds a preset film thickness limit, and determining a second processing duration of a second process stage according to film thickness data and removal rate of the first process stage.

2. The system of claim 1, wherein the processing tool is a chemical mechanical polishing tool.

3. The system of claim 1, wherein the controller further determines a first removal rate of the first removal process and uses it as a predicted second removal rate of the second removal process.

4. The system of claim 1, wherein the controller further determines the second processing duration according to the first film thickness measure, a preset target value of film thickness, and the first removal rate.

5. The system of claim 1, wherein the first removal rate is modified by a gain value, determined according to a statistical characteristic of a plurality of removal rate records.

6. A process control system for a film removal process, comprising:

means for receiving a preset film thickness and a preset thickness limit;

means for receiving an initial film thickness and a first film thickness before and after a first process stage, respectively, wherein the first process stage progresses for a first processing duration;

means for determining whether the first film thickness exceeds the film thickness limit;

means for an estimated second processing duration according to the first removal rate and the first film thickness, when the first film thickness exceeds the film thickness limit; and means for issuing a process command to direct a second process stage of the wafer for the second processing duration.

7. The system of claim 6, wherein the processing duration estimation means further determines a first removal rate of the first removal process and uses it as a predicted second removal rate of the second removal process.

8. The system of claim 6, wherein the processing duration estimation means further determines the second processing duration according to the first film thickness measure, a preset target value of film thickness, and the first removal rate.

9. The system of claim 6, wherein the first removal rate is modified by a gain value, determined according to a statistical characteristic of a plurality of removal rate records.

10. A method for film removal, comprising:

providing a preset target value of film thickness and a preset film thickness limit;

measuring an initial film thickness of a wafer;

performing a first process stage of the wafer;

measuring a first film thickness after the first process stage, wherein the first process stage progresses for a first processing duration;

determining whether the first film thickness exceeds the film thickness limit;

determining a second processing duration according to the first removal rate and the first film thickness, when the first film thickness exceeds the film thickness limit; and performing a second process stage of the wafer for the second processing duration.

11. The method of claim 10, wherein the process stage performs a chemical mechanical polishing process.

12. The method of claim 10, further determining a first removal rate of the first removal process and using it as a predicted second removal rate of the second removal process.

13. The method of claim 12, wherein the second processing duration determination further determines the second processing duration according to the first film thickness measure, a preset target value of film thickness, and the first removal rate.

14. The method of claim 12 further modifying the first removal rate using a gain value, determined according to a statistical characteristic of a plurality of removal rate records.

15. A computer readable storage medium for storing a computer program providing a method for controlling film removal process, the method comprising:

receiving a preset target value of film thickness and a preset thickness limit;

receiving an initial film thickness and a first film thickness before and after a first process stage, respectively, wherein the first process stage takes a first processing duration;

determining whether the first film thickness exceeds the film thickness limit;

determining a second processing duration according to the first removal rate and the first film thickness, when the first film thickness exceeds the film thickness limit; and issuing a process command to direct a second process stage of the wafer for the second processing duration.

16. The storage medium of claim 15, wherein the method further determines a first removal rate of the first removal process and uses it as a predicted second removal rate of the second removal process.

17. The storage medium of claim 15, wherein the second processing duration determination further determines the second processing duration according to the first film thickness measure, a preset target value of film thickness, and the first removal rate.

18. The storage medium of claim 15, wherein the method further modifies the first removal rate using a gain value, determined according to a statistical characteristic of a plurality of removal rate records.

* * * * *